US006653569B1

(12) United States Patent
Sung

(10) Patent No.: US 6,653,569 B1
(45) Date of Patent: Nov. 25, 2003

(54) SERIAL ATA CABLE

(76) Inventor: Yun-Ching Sung, No. 53-2, Community 6, Chih Pa Sub-ward, ChungLi City, TaoYuan Hsien (TW)

( * ) Notice: Subject to any disclaimer, the term of this patent is extended or adjusted under 35 U.S.C. 154(b) by 0 days.

(21) Appl. No.: 10/359,259

(22) Filed: Feb. 6, 2003

(51) Int. Cl.[7] ..... H01R 13/60

(52) U.S. Cl. ..... 174/88 R; 174/117 F; 439/567

(58) Field of Search ..... 174/117 F, 88 R; 439/358, 567, 570, 357, 571, 572

(56) References Cited

U.S. PATENT DOCUMENTS 6,585,536 B1 * 7/2003 Wu ..... 439/358
6,585,537 B1 * 7/2003 Lee ..... 439/358
6,589,074 B1 * 7/2003 Wu ..... 439/540.1
6,589,077 B1 * 7/2003 Wu ..... 439/567

* cited by examiner

*Primary Examiner*—Chau N. Nguyen
(74) *Attorney, Agent, or Firm*—Rosenberg, Klein & Lee

(57) ABSTRACT

A Serial ATA cable includes a connector body having a holder block at the rear side, terminals of two different lengths alternatively arranged in parallel in the connector body and the holder block, each terminal having an upright endpiece defining a Y-shaped engagement groove, a cable connected to the terminals, the cable having conductors respectively engaged in the Y-shaped engagement grooves of the endpieces of the terminals, a locating block fastened to the holder block and the connector body to hold down the cable, and a housing molded on the holder block and the locating block to fixedly secure the cable to the connector body.

1 Claim, 7 Drawing Sheets

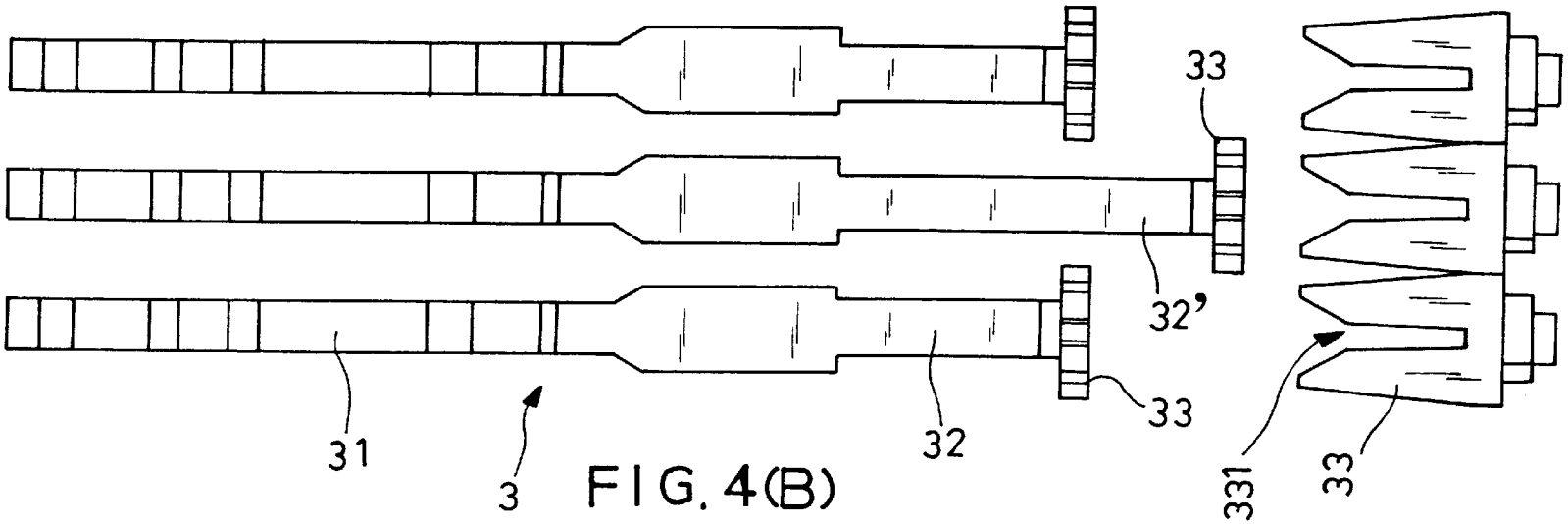
FIG. 4(B)
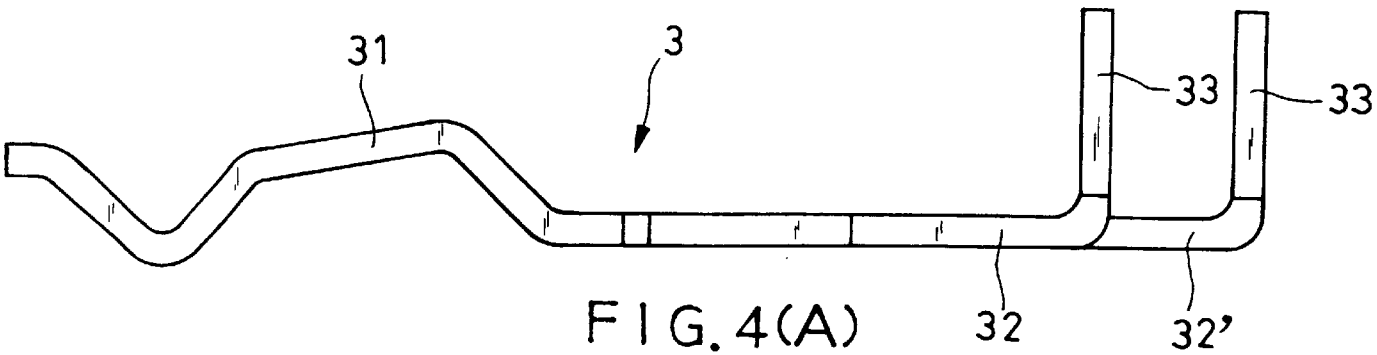
FIG. 4(A)
FIG. 4(C)

SERIAL ATA CABLE

BACKGROUND OF THE INVENTION

1. Field of the Invention

The present invention relates generally to a computer cable and, more particularly, to a Serial ATA cable 2. Description of the Related Art FIG. 1 illustrates an Ultra ATA parallel interconnect cable for computer. Because this design of cable has a big number of (at least 70 or 80) conductors arranged in parallel, the cable 11 and the connectors 12 occupy much installation space. This bulky drawback is a barrier to the fabrication of smaller and thinner computers and computer peripheral apparatus. In order to eliminate this problem, Serial ATA cables are developed. Serial ATA is the next generation storage interface standard for PC, designed to replace the ultra ATA parallel interconnect cable with a much smaller, more flexible serial design. FIGS. 2A and 2B illustrates a Serial ATA cable according to the prior art. This structure of Serial ATA cable comprises a connector body 13, a set of terminals 14 mounted in the connector body 13 and backwardly extended out of the rear side of the connector body 13, a cable 15, the cable 15 having conductors 151 respectively soldered to the terminals 14, and a housing 16 injection-molded from plastics on the connector body 13 and a part of the cable 15 to fix the cable 15 to the connector body 13. This structure of Serial ATA cable still has numerous drawbacks as follows:

1. It takes much time and labor to solder the conductors 151 to the terminals 14, and a toxic gas is produced when soldering the conductors 151 to the terminals 14.
2. It is difficult to control the quality because the conductors 151 are thin and the two middle conductors must be soldered to a common terminal. Improper soldering affects the electric properties of the Serial AT cable.
3. When molding the housing 16, the applied pressure may cause the terminals 151 to deform, and a short circuit may occur when the terminals 151 deformed.

SUMMARY OF THE INVENTION

The present invention has been accomplished under the circumstances in view. It is the main object of the present invention to provide a. Serial ATA cable, which eliminates the procedure of soldering the conductors of the cable to the terminals in the connector body. It is another object of the present invention to provide a Serial ATA cable, which requires less installation space. To achieve these and other objects of the present invention, the Serial ATA cable comprises a connector body, a holder block fastened to the rear side of the connector body, terminals of two different lengths alternatively arranged in parallel in the connector body and the holder block, each terminal having an upright endpiece defining a Y-shaped engagement groove, a cable connected to the terminals, the cable having conductors respectively engaged in the Y-shaped engagement grooves of the endpieces of the terminals, a locating block fastened to the holder block and the connector body to hold down the cable, and a housing molded on the holder block and the locating block to fixedly secure the cable to the connector body. Because the terminals are positioned in respective terminal grooves in the holder block and the conductors of the cable are set in respective conductor grooves in the holder block and secured to the Y-shaped engagement grooves of the endpieces of the terminals, the conductors are prohibited from interfering with one another. Further, because the conductors are protected within the holder block and the locating block, molding of the housing does not impact the conductors.

BRIEF DESCRIPTION OF THE DRAWINGS

FIG. 4A is a front view of the terminals according to the present invention.

FIG. 4B is a top view of the terminals according to the present invention.

FIG. 4C is the right side view of the terminals according to the present invention.

DETAILED DESCRIPTION OF THE INVENTION

Figure 1:
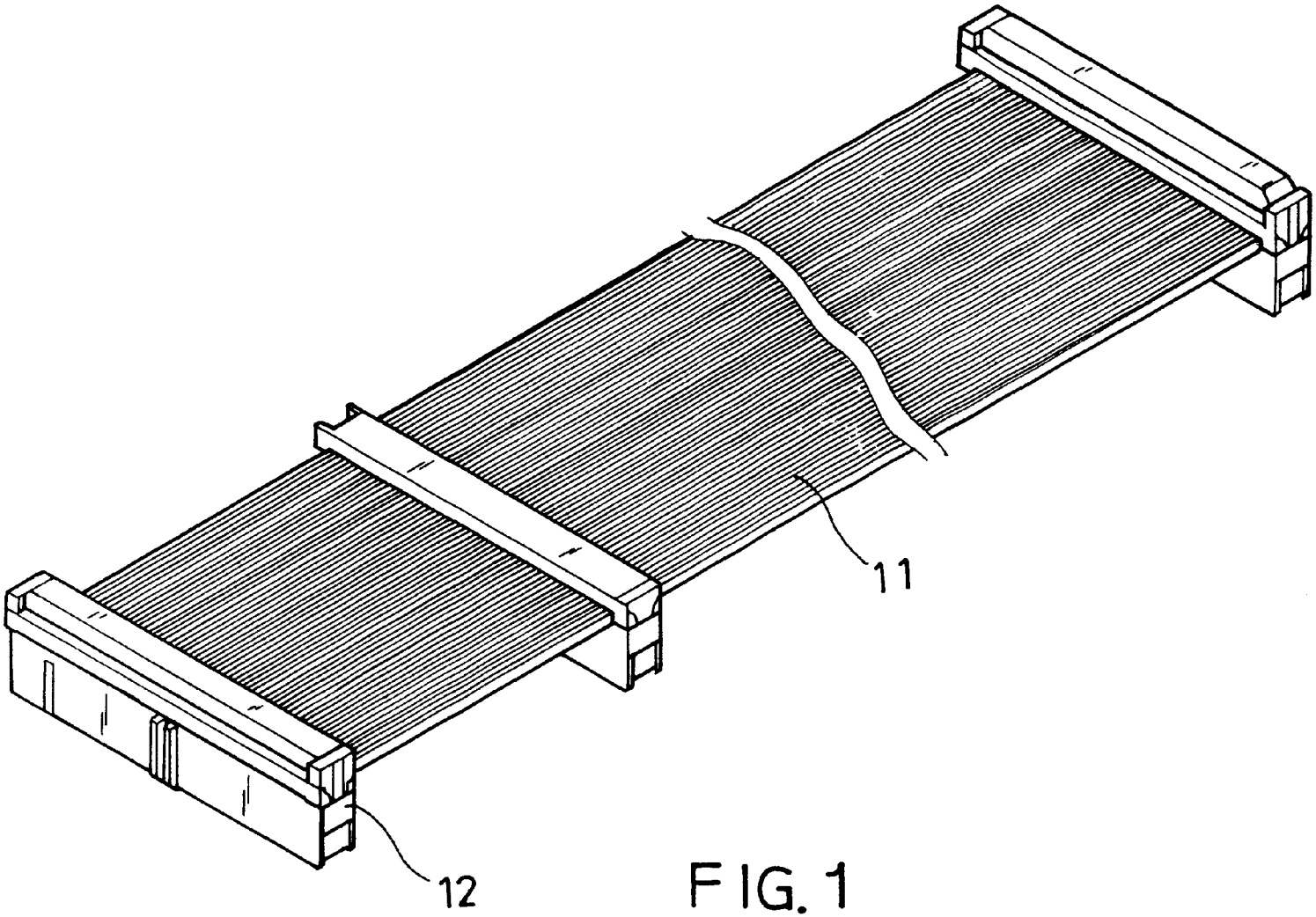
FIG. 1 (PRIOR ART)
FIG. 1 is an elevational view of an Ultra ATA parallel interconnect cable for computer. According to the prior art.
Figure 2A:
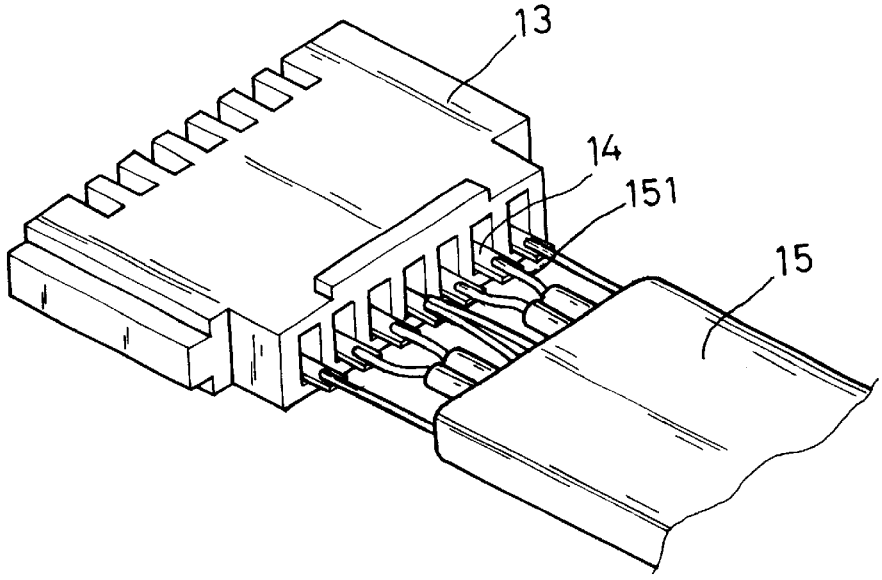
FIG. 2(A) (PRIOR ART)
FIG. 2A is an exploded view of a Serial ATA cable according to the prior art before the molding of the housing.
Figure 2B:
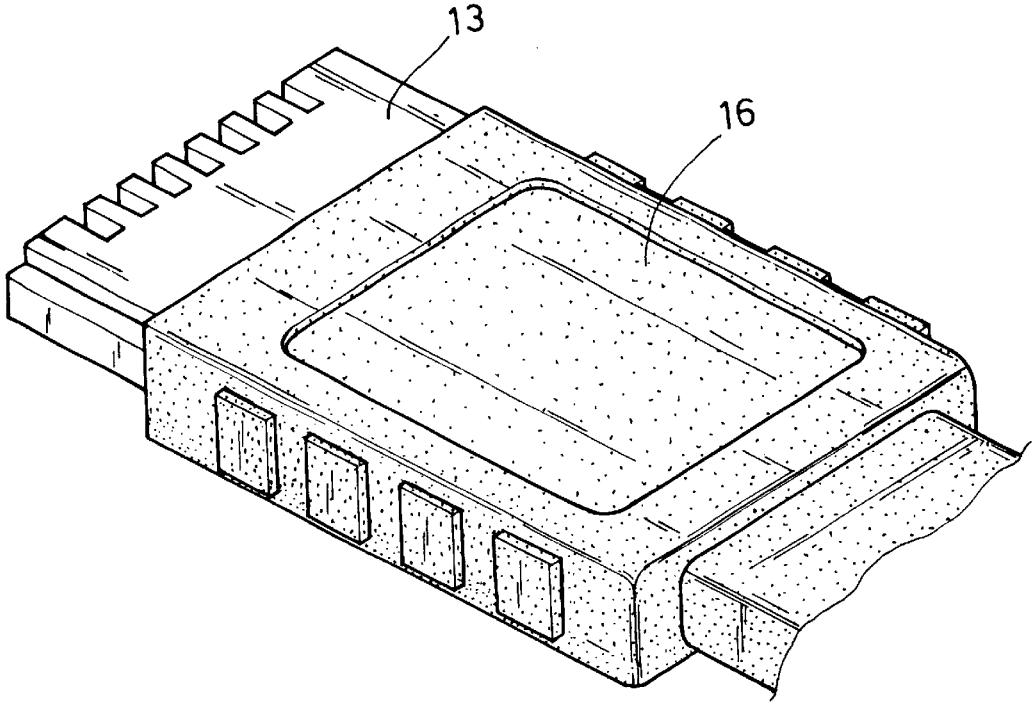
FIG. 2(B) (PRIOR ART)
FIG. 2B is an elevational view of the Serial ATA cable according to the prior art after the molding of the housing.
Figure 3:
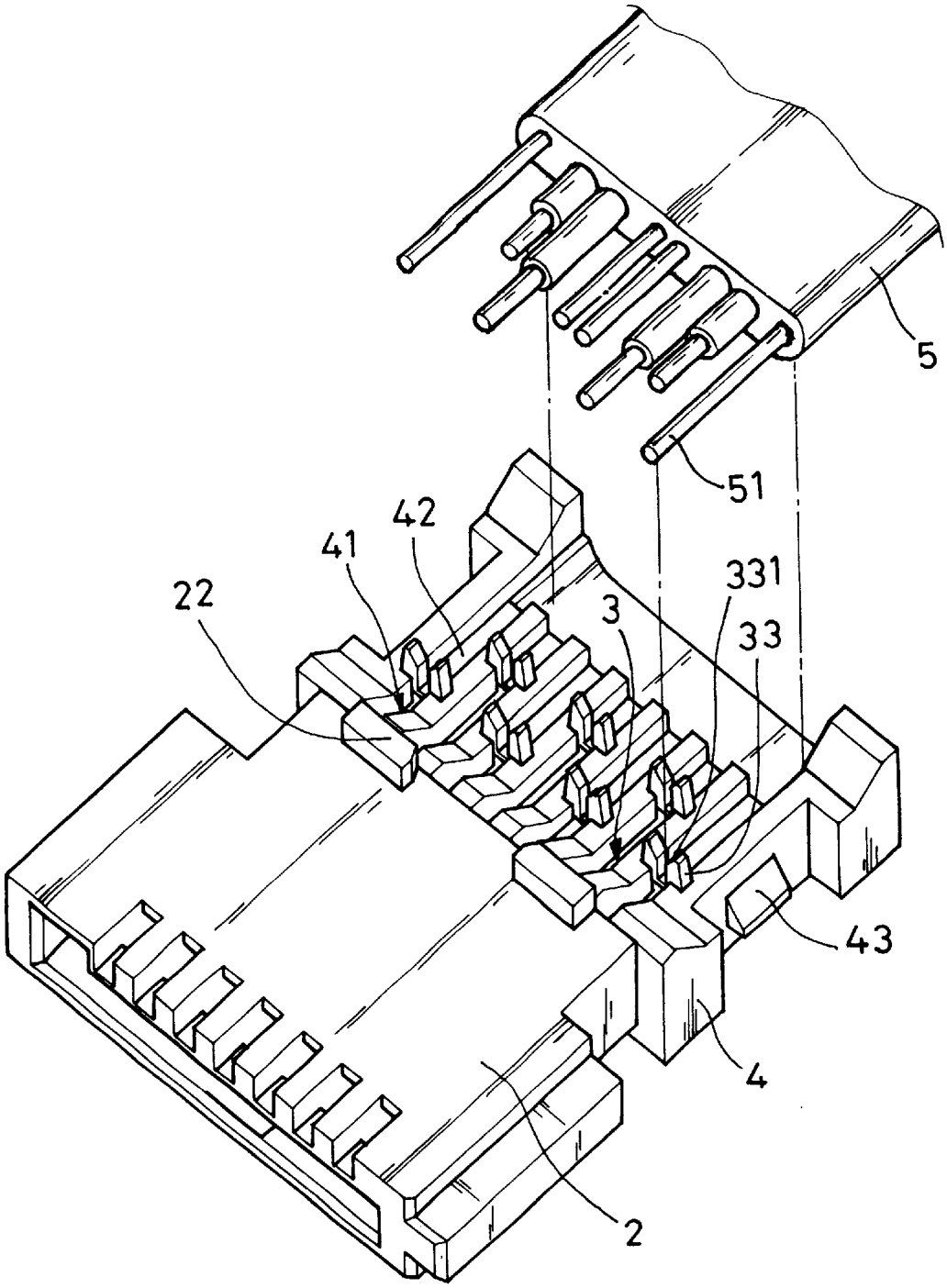
FIG. 3 is an exploded view of a part of the present invention, showing the terminals arranged in the holder block at the rear side of the connector body.

As shown in FIG. 3, a Serial ATA cable is shown comprising a connector body 2, a holder block 4 fastened to the rear side of the connector body 2, a plurality of terminals 3 mounted in the connector body 2 and the holder block 4, and a cable 5. The cable 5 has a plurality of conductors 51 respectively connected to the terminals 3 in the holder block 4. The connector body 2 comprises two upright locating blocks 22 near the rear side. The holder block 4 comprises a plurality of axially extended terminal grooves 41 adapted to receive the terminals 3, a plurality of axially extended conductor grooves 42 adapted to receive the conductors 51 of the cable 5, and two wedge-like retaining members 43 symmetrically disposed at two opposite lateral sides.

Referring to FIGS. 4A~4C and FIG. 3 again, each terminal comprises a forwardly extended and curved front contact portion 31, a backwardly extended rear positioning portion 32 or 32', and an endpiece 33 perpendicularly upwardly extended from the end of the rear positioning portion 32 or 32' remote from the front contact portion 31. The endpiece 33 has a substantially Y-shaped engagement groove 331. The terminals 3 include two types, one having a relatively shorter rear positioning portion 32 and the other having a relatively longer rear positioning portion 32'. These two types of terminals 3 are alternatively arranged in the terminal grooves 41 of the holder block 4 of the connector body 2. The conductors 51 of the cable 5 are respectively set in the Y-shaped engagement groove 331 of the endpieces 33 of the terminals 3, keeping the two middle conductors of the cable 5 positioned in the Y-shaped engagement groove 331 of the endpiece 33 of one common terminal 3.

Figure 5:
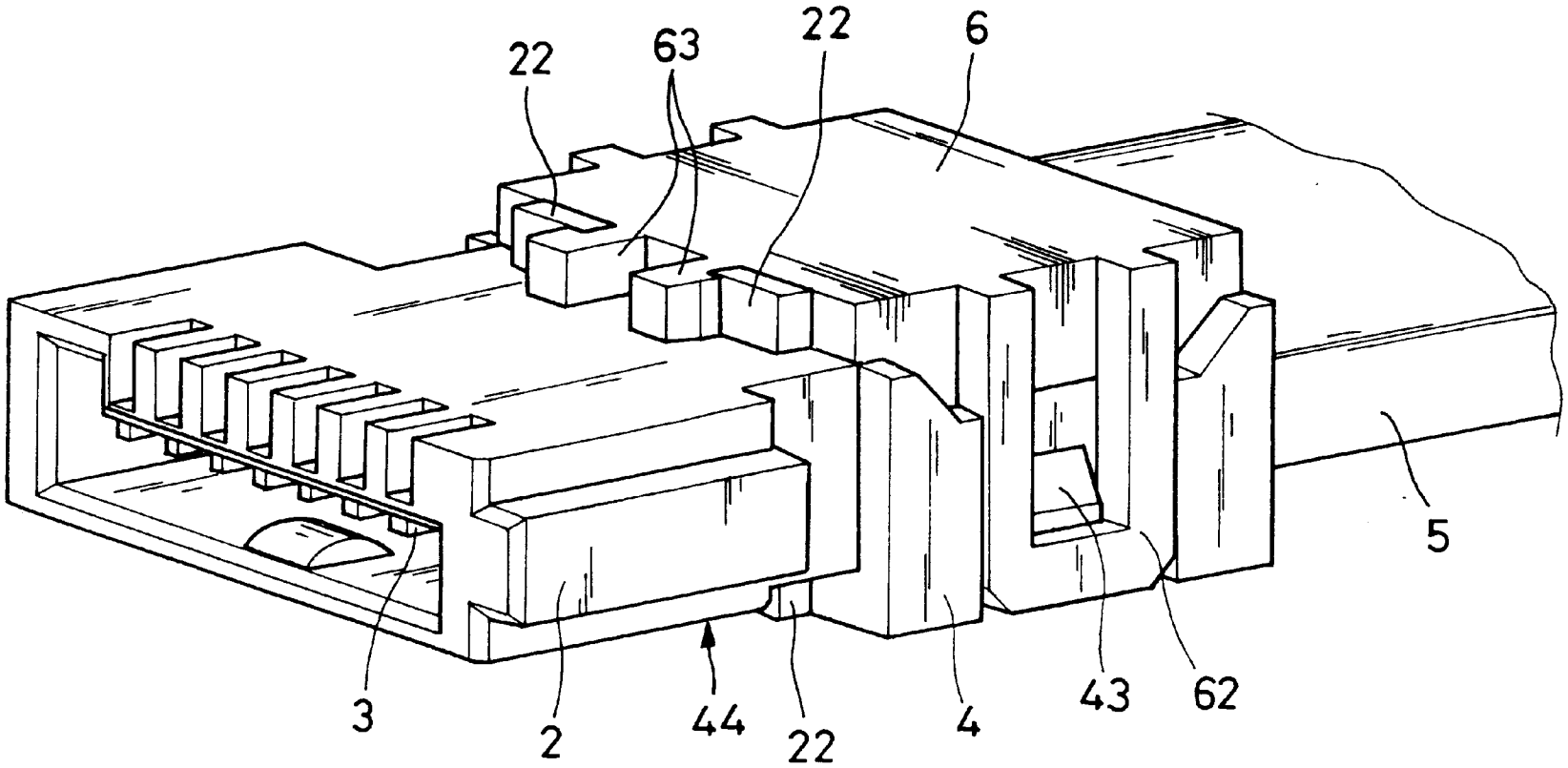
FIG. 5 is an elevational view of the Serial ATA cable before the molding of the housing according to the present invention.

Referring to FIG. 5 and FIG. 3 again, after the conductors 51 of the cable 5 have been set in the conductor grooves 42 and engaged into the Y-shaped engagement grooves 331 of the endpieces 33 of the terminals 3 properly, a locating block 6 is fastened to the holder block 4 to hold down the conductors 51 and to fixedly secure the cable 5 to the connector body 2. The locating block 6 comprises two downward lugs 62 symmetrically suspended at two opposite sides and respectively forced into engagement with the wedge-like retaining members 43 of the holder block 4, and two pliable hooks 63 protruded from the front side and respectively hooked on the upright locating blocks 22 of the connector body 2. Further, the holder block 4 has pliable hooks 44 fastened to the connector body 2.

Figure 6:
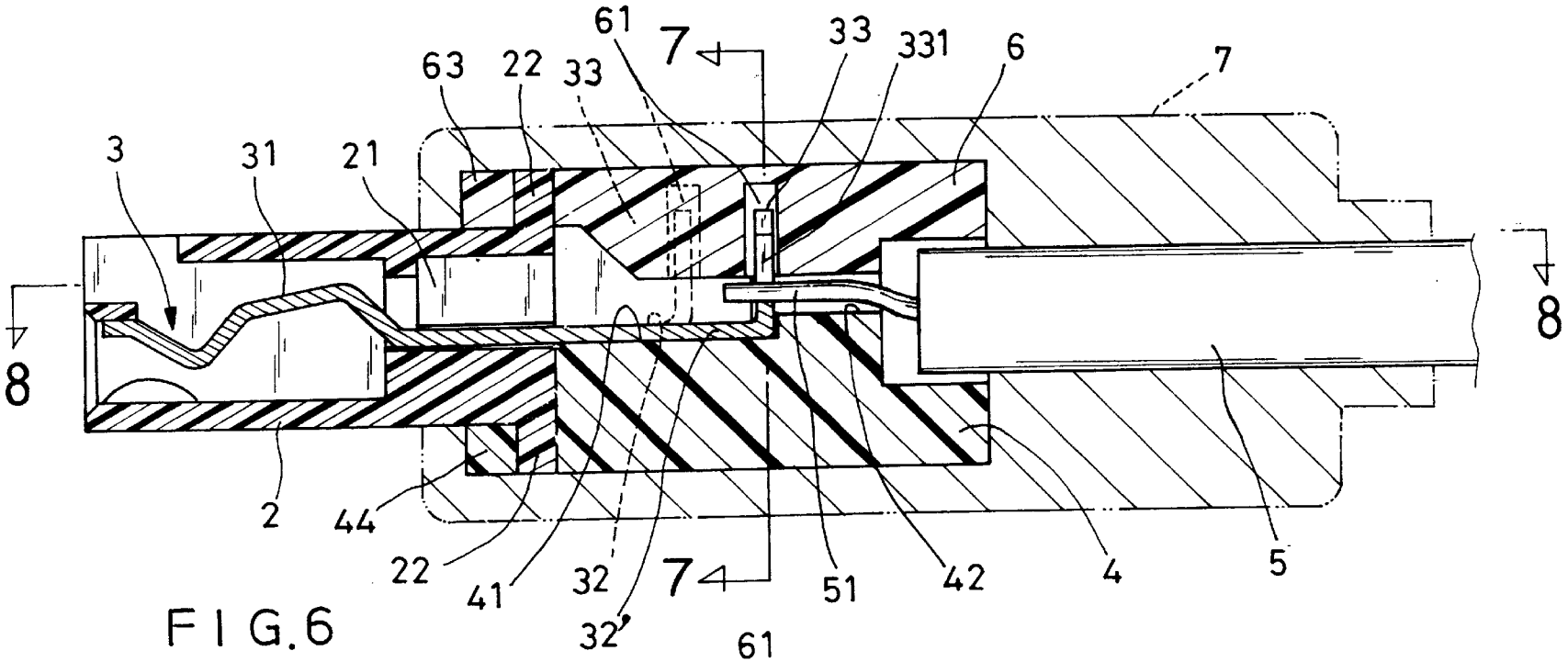
FIG. 6 is a sectional view of the Serial ATA cable according to the present invention.
Figure 7:
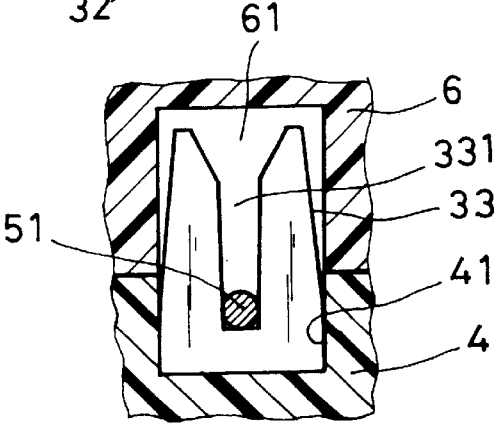
FIG. 7 is a sectional view taken along line 7—7 of FIG. 6.

Referring to FIGS. 6 and 7, the terminals 3 are mounted in the connector body 2 and the holder block 4, keeping the front contact portions 31 suspended in respective terminal slots 21 of the connector body 2 and the rear positioning portions 32 and 32' positioned in the terminal grooves 41 of the holder block 4, and the conductors 51 are respectively engaged into the Y-shaped engagement grooves 331 of the endpieces 33 of the terminals 3 and held down by the locating block 6. The locating block 6 has recessed bottom holes 61, which receive the endpieces 33 of the terminals 3, holding the conductors 51 of the cable 5 in the Y-shaped engagement grooves 331 of the endpieces 33 of the terminals 3.

Figure 8:
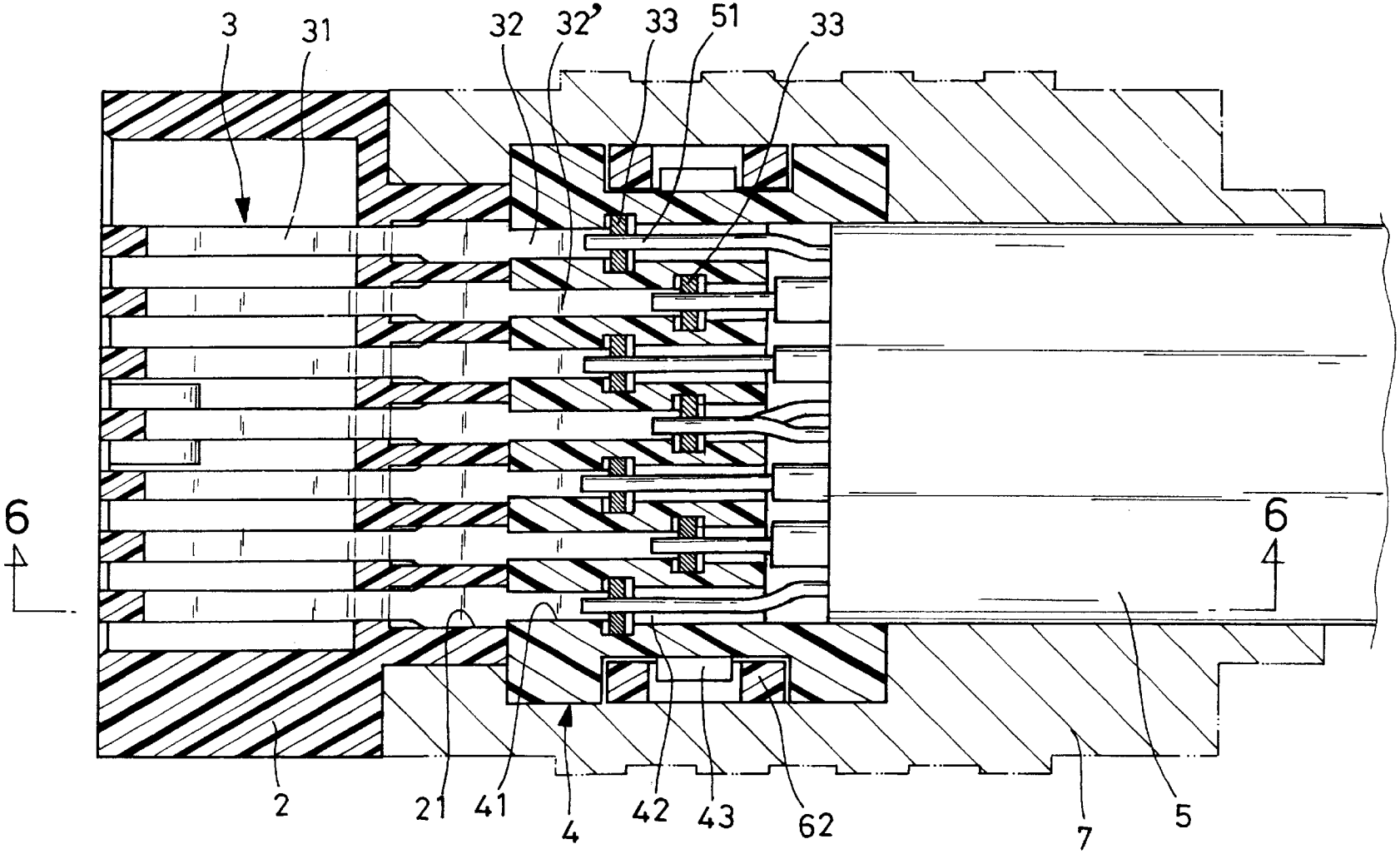
FIG. 8 is a sectional view taken along line 8—8 of FIG. 6.

Referring to FIG. 8 and FIG. 6 again, the endpieces 33 of the terminals 3 are alternatively in two lines, preventing contact or interference between conductors 51. The design of the invention eliminates the procedure of soldering the conductors 51 to the terminals 3. After installation of the locating block 6, a housing 7 is injection-molded from plastics on the rear part of the connector body 2, the holder block 4, the locating block 6, and a part of the cable 5. Because the conductors 51 are positioned in the endpieces 33 of the terminals 33 and protected within the holder block 4 and the locating block 6, the molding of the housing 7 does not impact the conductors 51.

A prototype of Serial ATA cable has been constructed within the features of FIGS. 3~8. The Serial ATA cable functions smoothly to provide all the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A Serial ATA cable comprising:

a connector body holding a set of terminals, said connector body comprising two upright locating blocks disposed at a top side thereof near a rear side thereof, said terminals including relatively longer terminals and relatively shorter terminals alternatively arranged in parallel and respectively extended out of the rear side of said connector body to different distances, said terminals each having a rear positioning portion and an endpiece perpendicularly upwardly extended from said rear positioning portion, said endpiece having a Y-shaped engagement groove;

a holder block fastened to the rear side of said connector body, said holder block comprising a plurality of axially extended terminal grooves, which receive the rear positioning portions and endpieces of said terminals, a plurality of axially extended conductor grooves, and two wedge-like retaining members symmetrically disposed at two opposite lateral sides thereof;

a cable connected to said holder block, said cable comprising a plurality of conductors respectively inserted into the conductor grooves of said holder block and engaged into the Y-shaped engagement grooves of the endpieces of said terminals;

a locating block covered on said holder block to hold down said cable, said locating block comprising two downward lugs symmetrically suspended at two opposite sides thereof and respectively forced into engagement with the wedge-like retaining members of said holder block, two pliable hooks protruded from a front side thereof and respectively hooked on the two upright locating blocks of said connector body, and a plurality of recessed bottom holes, which receive the Y-shaped engagement grooves of the endpieces of said terminals; and a housing covering a rear part of said connector body, said holder block, said locating block, and a part of said cable.

* * * * *